United States Patent [19]

Boyen

[11] 4,308,869

[45] Jan. 5, 1982

[54] BRASSIERE

[76] Inventor: Steven G. Boyen, 3875 Wilshire Blvd., Los Angeles, Calif. 90010

[21] Appl. No.: 126,454

[22] Filed: Mar. 3, 1980

[51] Int. Cl.[3] ..... A41C 3/10; A41C 3/00

[52] U.S. Cl. ..... 128/478; 128/481; 128/462

[58] Field of Search ..... 128/481, 478, 462, 150

[56] References Cited

U.S. PATENT DOCUMENTS

| | | | |
|---|---|---|---|
| 1,250,875 | 12/1917 | Heuchan | 128/462 |
| 2,156,512 | 5/1939 | Pitcher | 128/481 |
| 3,285,247 | 11/1966 | Morin | 128/479 |
| 3,401,407 | 9/1968 | Pittman | 128/481 |
| 3,517,671 | 6/1976 | Freedman | 128/478 |
| 4,199,825 | 4/1980 | Knoche | 128/479 |

OTHER PUBLICATIONS

Sears, Roebuck and Co., Spring/Summer 1977, p. 165, (6 and 7), Sensuous See-through Bras.

*Primary Examiner*—Doris L. Troutman
*Attorney, Agent, or Firm*—John Joseph Hall

[57] ABSTRACT

A brassiere with an inner structure having the contour, shape and color of a natural breast of a woman, including a nipple and areola, and an outer covering of translucent material closely fitting over the inner structure, and with shoulder straps.

3 Claims, 4 Drawing Figures

BRASSIERE

SUMMARY OF THE INVENTION

The invention comprises a new and useful brassiere for women who have had one or both breasts removed by surgery or damaged or deformed by injury or otherwise. The brassiere has two basic elements, an inner structure and an outer covering fitting closely over the inner structure and provided with shoulder straps.

The inner structure is formed in two breasts cups, each shaped to resemble the contour of a woman's breast and made from a relatively soft, semi-rigid material having a suitable skin color. Each breast cup is provided with a nipple member surrounded by an areola to give the appearance of a natural breast of a woman.

The outer covering fits closely over each breast cup and is made of a translucent or sheer material to give the effect of a brassiere surrounding the natural breasts of a woman.

An object of the invention is to provide a brassiere which produces the appearance of a natural breast of a woman under a translucent covering.

Another object of the invention is to provide a brassiere for women who have had one or both breasts removed by surgery, or damaged or deformed by injury or otherwise, which simulates the lost or damaged breast or breasts.

A further object of this invention is to provide a brassiere which reveals the surface of a breast cup having the appearance of a natural breast of a woman.

These and other objects will be more readily understood by reference to the following description and claims, taken in conjunction with the accompanying drawing, in which:

Figure 1:
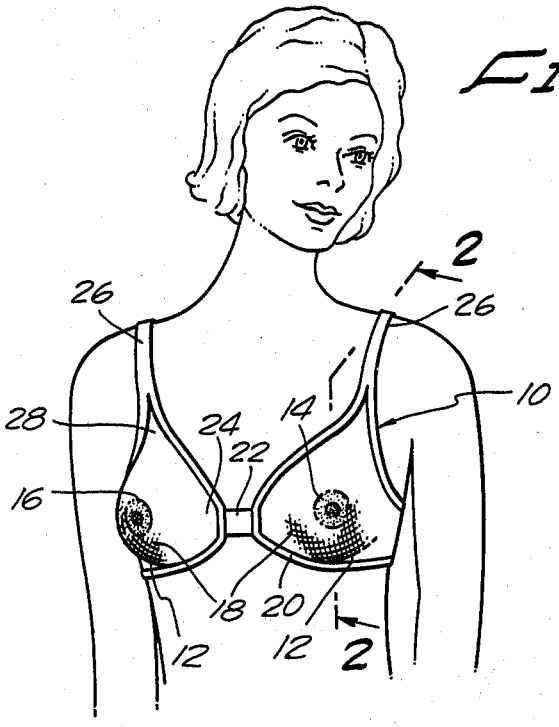
FIG. 1 is a front perspective view of an embodiment of my invention in place on a woman.
Figure 2:
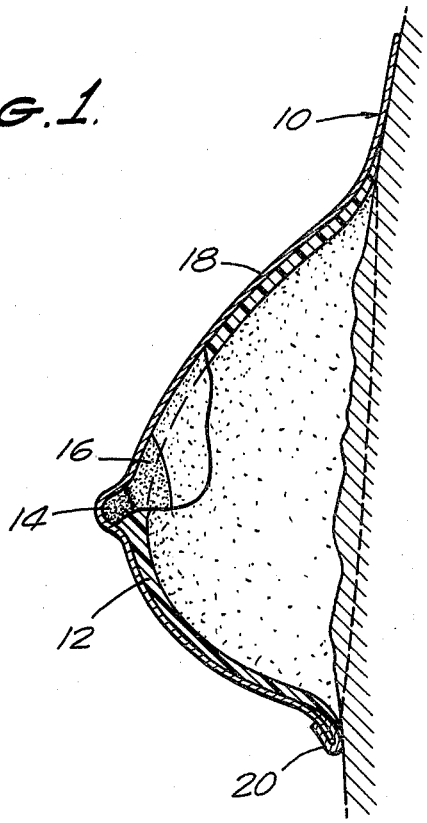
FIG. 2 is a view taken along line 2—2 of FIG. 1.
Figure 3:
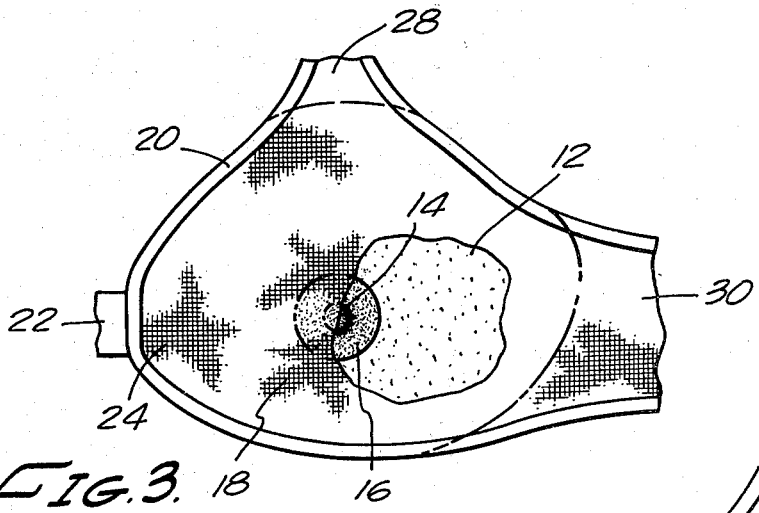
FIG. 3 is an enlarged view of a portion of the right breast cup of FIG. 1.
Figure 4:
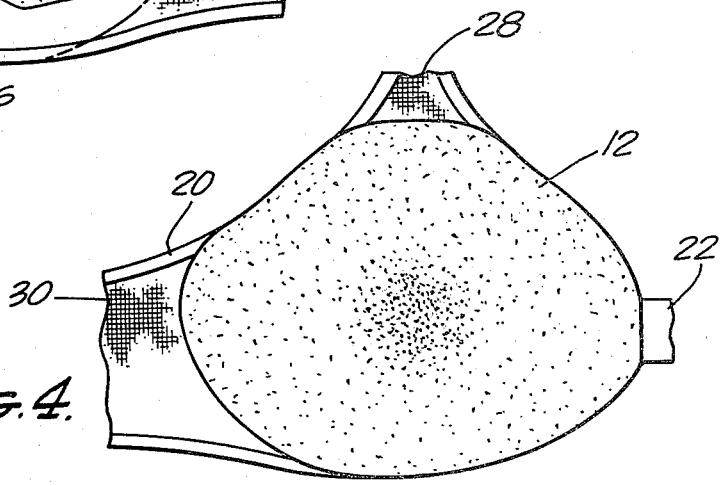
FIG. 4 is a rear view of FIG. 3.

The brassiere 10 has 2 breast cups 12 shaped in the form of a woman's breast. Each of cups 12 is constructed from a soft or semi-rigid material such as rubber or a suitable plastic or other material. Each of cups 12 is provided with a nipple member 14 located in the approximate center of the outer surface of cup 12, and surrounded by an areola 16 to further simulate the appearance of the natural breasts of a woman.

The color of the material used for breast cups 12, nipple member 14, and areola 16 may be varied as desired to match or blend with, the skin color of the person wearing the brassiere 10. The size and contour of the breast cup 12, nipple member 14, and the areola 16 may be varied to best complement the appearance of the person wearing the brassiere 10. The nipple member 14 and areola 16 are colored or made from a material darker than breast cups 12 to simulate the appearance of a natural nipple and areola of a woman's breast.

Breast cups 12 are each fitted with an outer covering 18 over their outer surfaces. Covering 18 is preferably made from a translucent or sheer material such as silk, polyester, and the like, and closely fits over breast cups 12 to give the appearance of a convential brassiere covering the natural breasts of a woman. Covering 18 has an edge 20 of hemmed material or the like at its outer perimeter which is connected by any suitable means such as sewing or stitching to the corresponding outer edge of breast cups 12. A connecting member 22 joins the inner ends 24 of covering 18 together.

Shoulder straps 26 are connected to the top portions 28 and side portions 30 of covering 18 by any suitable means.

In operation, the brassiere is placed on a woman's body in the same manner as a conventional brassiere. If desired, packing material or internal stuffing of some sort may be used to fill in the missing portion of the woman's breast which has been removed or damaged, as desired.

In this way, the use of the invention will simulate the appearance of a natural breast or breasts of a woman and satisfy the aesthetic desires of the person wearing the brassiere.

Although I have described my invention in detail with reference to a preferred embodiment thereof, it is understood that numerous changes in the details of the construction and arrangement of parts may be made within the scope of my invention hereinafter claimed.

I claim:

1. A brassiere comprising:

two breast cups, each formed in the shape of a woman's breast, and having the approximate center of the outer surface of each cup integrally formed into a nipple member, each of said nipple members being ductless and surrounded by an areola, said areola being integrally formed from one of said breast cups;

a translucent covering fitting over each of said breast cups and having an edge member at its outer perimeter, said edge member being connected to the corresponding outer edge of said breast cups and;

means connecting said breast cups to each other and to shoulder straps.

2. A brassiere according to claim 1 in which said breast cups, nipple member, and areola, each have the color of a natural breast of a woman.

3. A brassiere according to claim 1 in which said nipple is located at the center of said outer surface of each of said breast cups.

* * * * *